US005617742A

United States Patent [19]

Toppel

[11] Patent Number: 5,617,742

[45] Date of Patent: Apr. 8, 1997

[54] DISTILLATION APPARATUS

[75] Inventor: Karl O. Toppel, Flemington, N.J.

[73] Assignee: The BOC Group, Inc., New Providence, N.J.

[21] Appl. No.: 640,301

[22] Filed: Apr. 30, 1996

[51] Int. Cl.[6] ..... F25J 3/04

[52] U.S. Cl. ..... 62/643; 62/902; 62/911

[58] Field of Search ..... 62/297, 643, 901, 62/902, 905, 907, 911; 202/83

[56] References Cited

U.S. PATENT DOCUMENTS 5,205,042 4/1993 Greter et al. ..... 62/125
5,461,871 10/1995 Bracque et al. ..... 62/905 X

FOREIGN PATENT DOCUMENTS 0538857 4/1993 European Pat. Off. ..... 62/905
2422450 12/1974 Germany ..... 62/911

*Primary Examiner*—Christopher Kilner
*Attorney, Agent, or Firm*—David M. Rosenblum; Larry R. Cassett

[57] ABSTRACT

A distillation apparatus having applicability to an air separation plant in which a distillation column is suspended within a containment sleeve from a main heat exchanger or a head condenser of the distillation column. The suspension of the distillation column is flexible so that the distillation column can assume a vertical orientation under influence of gravitational force to be self-leveling.

6 Claims, 1 Drawing Sheet

DISTILLATION APPARATUS

BACKGROUND OF THE INVENTION

The present invention relates to a distillation apparatus having applicability to air separation in which a main heat exchanger and one or more distillation columns are enclosed within a sleeve-like containment. More particularly, the present invention relates to such an apparatus in which a distillation column is suspended within the containment from the main heat exchanger or from a head condenser so that the distillation column assumes a vertical orientation under influence of gravitational force.

Mixtures are distilled by contacting liquid and vapor phases of the mixture on liquid-vapor contact elements contained within a distillation column. The liquid-vapor contact elements can be trays, random packing and structured packing. Constant vapor and liquid flow rates are desired across the distillation column in order the distillation column to be efficiently utilized and to have predicable performance characteristics. In order to promote constant liquid and vapor flow rates, distillation columns are erected so that they will assume a vertical orientation. However, in case of small plants, for instance, packaged air separation plants which are encased in vacuum insulated enclosures, the assurance of vertical orientation can be problematical. One attempt to solve this problem can be found in U.S. Pat. No. 5,205,042. In this patent, a liquid nitrogen assist plant is disclosed that employs a distillation column connected to a storage container. The distillation column and storage containing are enclosed within a vacuum insulated container. A suspended mass and locator ring, referable to the orientation of the distillation column, are used to level the vacuum insulated container so that the distillation column will be erected in the necessary vertical orientation.

As will be discussed, the present invention provides a distillation apparatus in which the distillation column is self-leveling and thus, the deployment of the apparatus of the subject invention is far simpler than prior art plants such as packaged air separation plants.

SUMMARY OF THE INVENTION

The present invention provides a distillation apparatus for rectifying a mixture comprising a main heat exchange means for cooling the mixture to a temperature suitable for its rectification and at least one distillation column. A containment means is provided for containing the heat exchange means and the at least one distillation column. A suspension means is provided for suspending the heat exchange means and the at least one distillation column within a top region of the containment means so that the distillation column assumes a vertical orientation under the influence of gravitational force. In such manner, the present invention does not require outside intervention to level the distillation column, for instance, by sensing its verticality and then leveling the containment means. Thus, the present invention provides a distillation apparatus which provides a more direct and less complicated set-up than prior art plants.

BRIEF DESCRIPTION OF THE DRAWINGS

While the specification concludes with claims distinctly pointing out the subject matter that Applicant regards as his invention, it is believed that the present invention will be better understood when taken in connection with the accompanying drawing in which the sole figure is a schematic illustration of an apparatus for separating air in accordance with the present invention.

DETAILED DESCRIPTION

Figure 1:
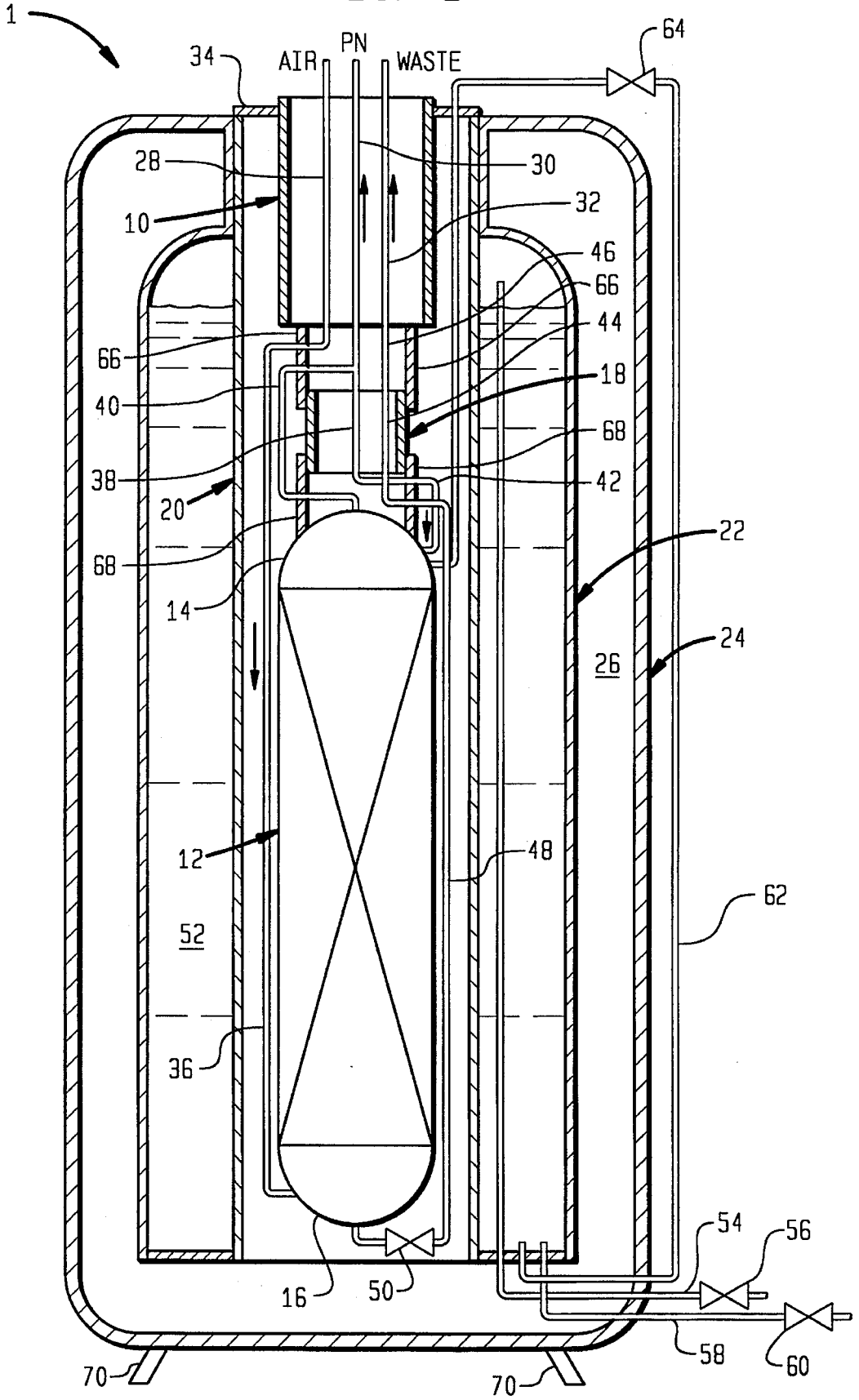

With reference to the Figure, an apparatus 1 for separating air in accordance with the present invention is illustrated. Apparatus 1 is a packaged air separation plant of the type known as a liquid nitrogen assist plant. It is to be noted, that the present invention is not limited to any particular type of distillation apparatus and has broader applicability to distillation units which could be used to separate mixtures other than air and could employ multiple columns.

Apparatus 1 includes a main heat exchanger 10 for cooling air to a temperature suitable for its rectification and a distillation column 12 that produces a nitrogen product within a tower overhead region 14 thereof and an oxygen enriched liquid within a liquid column bottoms region 16. Reflux to column 12 is produced within a head condenser 18 interposed between main heat exchanger 10 and distillation column 12. Main heat exchanger 10, distillation column 12 and head condenser 18 are mounted in an in-line relationship within a sleeve 20. Sleeve 20 penetrates a liquid nitrogen storage container 22 which is in mm housed within a vacuum insulation tank 24 containing insulation 26. Although not illustrated, sleeve 20 could be filled with insulation to prevent condensation of air. Insulation could also be utilized within sleeve 20 if employed outside of vacuum insulation tank 24.

Main heat exchanger 10 and head condenser 18 are each of plate and fin construction. Main heat exchanger 10 is provided with an air passage 28 and countercurrent product nitrogen and waste passages 30 and 32 for the passage of product nitrogen and waste. Air cools within passageway 28 to a temperature suitable for its rectification, namely a temperature at or near the dewpoint of air. At the same time, product nitrogen and waste countercurrently flowing in product nitrogen and waste passages 30 and 32 warm to near ambient temperatures. Main heat exchanger 10 is connected to a top suspension flange 34 which is in turn connected to vacuum insulation tank 24. Top suspension flange 34 is removable to allow removal of main heat exchanger 10, heat condenser 18, and distillation column 12 from vacuum insulation tank 24 as a unit. An air conduit 36 is connected to air passageway 28 for introducing the air into column bottoms region 16 at distillation column 12.

Head condenser 18 has a nitrogen passageway 38 connected to tower overhead region 14 of distillation column 12 by a product conduit 40 which is also connected to product nitrogen passageway 30 of main heat exchanger 10. In such manner, part of the product nitrogen is condensed within nitrogen passageway 38 and is introduced via a reflux conduit 42 back into tower overhead region 14 of distillation column 12. The coolant for such condensation is provided by a coolant passageway 44 within head condenser 18. Coolant passageway 44 is connected to waste passageway 32 via a waste conduit 46. Coolant passageway 44 is linked to column bottoms region 16 of distillation column 10 by means of a waste line 48. A suitable temperature difference between the oxygen-rich liquid contained within column bottoms region 16 and the product nitrogen to be condensed is provided by valve expanding a waste stream (composed of the oxygen-rich liquid) by an expansion valve 50 provided within waste line 48.

In any cryogenic distillation column system, there invariably will be a heat leakage from the environment. In order to counteract such heat leakage, refrigeration must be supplied. In air separation apparatus 1, such refrigeration is supplied via liquid nitrogen contained within liquid nitrogen storage tank 22. Liquid nitrogen storage tank 22 contains liquid nitrogen 52 which is introduced into liquid nitrogen storage tank 22 by fill line 54. A cutoff valve 56 is provided to close off fill line 54. Additionally, a drain line 58 is provided for draining liquid nitrogen 52 from liquid nitrogen storage tank 22 should the need arise. A cutoff valve 60 is provided within drain line 58. A transfer line 62 causes liquid nitrogen to be introduced into tower overhead region 14 of distillation column 12 in order to add refrigeration to distillation column 12. Valve expansion, provided by an expansion valve 64, lowers the temperature of liquid nitrogen passing through transfer line 62.

Head condenser 18 is connected to main heat exchanger 10 by means of four supports 66. Distillation column 12 is in turn suspended from head condenser 18 by four supports 68. Supports 66 and 68 each have a rectangular transverse cross-section. It is to be noted that only two of each of supports 66 and 68 can be seen in the Figure because the other unseen supports lie directly behind the illustrated two of each of set of supports 66 and 68. Preferably supports 66 and 68 are fabricated to flex under influence of gravitational force on distillation column 36. Such fabrication can be effected by appropriate choice of a flexible material and/or appropriate sectional design of the moment of inertia of each of supports 66 and 68. Thus, since vacuum insulation tank 24 rests on legs 70 and may not be perfectly level, distillation column 12 pendulously swings into a level position upon deformation of supports 66 and 68. Nitrogen product line 40, air line 36, coolant line 46 are also made to flex without kinking by provision of bends or bellows-like joints and other well known methods of allowing piping system to have some "give".

As can be appreciated by those skilled in the art, main heat exchanger 10 and head condenser 18 could be constructed as a single unit and as such, distillation column 12 would be suspended from the main heat exchanger incorporating a head condenser into its design. Moreover, although main heat exchanger 10 is rigidly connected to top suspension flange 34, it could be flexibly supported from top suspension flange 34 so that the distillation column 12, main heat exchanger 10 and head condenser 18 swung from such support.

Although sleeve 20 is illustrated as being mounted within a liquid nitrogen storage tank 22 and in turn, vacuum insulation tank 24, this is only for convenience of packaging. Specifically, sleeve 20 could be made free standing on its own legs and connected by suitable piping to liquid nitrogen storage tank 22 mounted within a vacuum insulation tank.

While the present invention has been described with reference to a preferred embodiment, as will occur to those skilled in the art, numerous changes, additions and omissions may be made without departing from the spirit and scope of the present invention.

I claim:

1. A distillation apparatus for rectifying a mixture comprising:

heat exchange means for cooling the mixture to a temperature suitable for its rectification;

at least one distillation column;

containment means for containing said heat exchange means and said at least one distillation column; and suspension means for suspending said heat exchange means and said at least one distillation column within a top region of said containment means so that said distillation column assumes a vertical orientation under influence of gravitational force.

2. The distillation apparatus of claim 1, wherein:

said containment means comprises a sleeve having a top mounting flange capping said top region thereof;

said at least one distillation column is located below heat exchange means in an in-line relationship; and said suspension means suspends at least said main heat exchange means from said top mounting flange.

3. The apparatus of claim 2, wherein:

said mixture comprises air; and said at least one distillation column comprises a single distillation column configured to produce a nitrogen rich tower overhead.

4. The distillation apparatus of claim 3, wherein:

a head condenser is interposed between said main heat exchange means and said single distillation column;

said suspension means comprises first and second connection means for connecting said main heat exchange means to said top mounting flange and said single distillation column to said main heat exchange means, respectively; and at least one of said first and second connection means is sufficiently flexible to allow said distillation column to assume said vertical orientation.

5. The distillation apparatus of claim 3 or claim 4, further comprising:

a nitrogen supply tank to contain liquid nitrogen;

a conduit to supply said liquid nitrogen to a top region of said distillation column;

a vacuum insolation tank surrounding said nitrogen supply tank; and insolation located between said vacuum insolation tank and said nitrogen supply tank.

6. The distillation apparatus of claim 5, wherein said containment means comprises a sleeve penetrating said vacuum insolation tank and said nitrogen supply tank.

* * * * *